US006597129B2

(12) United States Patent
Newman

(10) Patent No.: US 6,597,129 B2
(45) Date of Patent: Jul. 22, 2003

(54) LIGHTING FIXTURE AND SYSTEM

(76) Inventor: Jeffrey Jay Newman, 8901 Wiles Rd. Unit 6-308, Coral Springs, FL (US) 33067

( * ) Notice: Subject to any disclaimer, the term of this patent is extended or adjusted under 35 U.S.C. 154(b) by 111 days.

(21) Appl. No.: 09/990,937

(22) Filed: Nov. 15, 2001

(65) Prior Publication Data

US 2003/0090903 A1 May 15, 2003

(51) Int. Cl.[7] ..... G05F 1/00; F21S 8/00
(52) U.S. Cl. ..... 315/291; 362/147
(58) Field of Search ..... 315/291, 224, 315/312; 362/147, 150

(56) References Cited

U.S. PATENT DOCUMENTS 4,688,154 A * 8/1987 Nilssen ..... 362/147
6,107,756 A * 8/2000 Parra ..... 315/324
6,246,182 B1 * 6/2001 Yamasaki et al. ..... 315/209 R
6,515,437 B1 * 2/2003 Zinkler et al. ..... 315/312
6,516,584 B1 * 2/2003 Rudd ..... 52/731.8

* cited by examiner

*Primary Examiner*—Don Wong
*Assistant Examiner*—Minh D A
(74) *Attorney, Agent, or Firm*—Kenneth E. Merklen

(57) ABSTRACT

A track lighting and fixture system provides for applying a primary power supply directly to conduits extending along the length of the track. One or more electricity converters, such as AC to AC converters, each of which change the primary power into a secondary power which has characteristics which differ from the characteristics of the primary power, are connected, both physically and electrically to the track, providing a varity of outputs of secondary power. Lighting fixtures and electric accessories, each requiring electric power having characteristics that differ from each other and each of which differ from the characteristics of the primary power may be used in the same track lighting and fixture system.

12 Claims, 2 Drawing Sheets

LIGHTING FIXTURE AND SYSTEM

BACKGROUND OF THE INVENTION

1. Field of the Invention

The present invention relates to lighting fixtures and systems, particularly to a lighting system that is normally used in doors, known as track lighting.

2. Prior Art

Track lighting systems normally includes an elongated fixture/conductor track having a generally U shape with two conductors for electric power extending longitudinally along the length of the interior walls of the U shaped track. The two conductors are normally open conduits secured inside grooves of the track, insulated from the track. Each conduit is connected to opposite terminals of an electric power supply. A locking electric fixture, supported in the U shaped track, may be unlocked and moved along the track as desired. When locked in a location along the track, the fixture makes electric contact with each conduit in the track. The locking electric fixture may be an electric receptacle into which an electric plug is connected or electric socket into which an electric bulb is screwed, or may be an electric connection on to which an electric fixture, such as a hanging light fixture or chandelier is hung and/or connected. The U shaped track may be fixed to a surface, such as a wall, a ceiling or a floor of a room or space, for example. The two open conduits supported along the track are each connected to opposing terminals of an electric power supply.

In the United States of America, standard electric power supplied to homes and/or business establishments is an alternating current (AC) power, 110–120 volt, 60 cycle AC power. Most electric wiring systems, electric lighting fixtures and electric appliances have been developed and designed to carry and be driven by 110–120 volt, 60 cycle AC power. A popular light bulb in current use is the incandescent light bulb designed to be driven by a 110–120 volt, 60 cycle AC electric power. However, it has been found that light bulbs may be designed to be driven by an electric power that has different characteristics than the normal electric 110–120 volt, 60 cycle AC power. For example, 12 volt high intensity lamp bulbs, designed to be driven by a 12 volt electric power source, are available over the counter. These 12 volt lamp bulbs provide a more intense light than the average incandescent light bulb driven by 110–120 volt, 60 cycle power. The 12 volt high intensity lamp system usually includes an AC to AC converter to reduce the 110–120 volts to 12 volts. Also, fluorescent lamps are available that are driven by a pulsed AC, the pulsed AC being converted from the 110–120 volt, 60 cycle power. Lamp bulbs are available, over the counter, in different forms and designs, which require an electric driving power with different electric characteristics than provided by the normal 110–120 volt, 60 cycle AC power. In order to adapt, for example, these more intense light lamp bulbs to track lighting systems, an AC to AC converter was interposed between the track supporting the open conduits and the source of electric power. The AC to AC converter, which is well known in the art, changes the primary power into a secondary electric power which has electric values or characteristics which different from the electric characteristics of the primary power. The AC to AC converter is interposed between the electric power source and the light bulb and in track lighting system the AC to AC converter is interposed between the normal or primary electric power, 110–120 volt, 60 cycle AC, for example, and the conduits in the track. In conventional track lighting systems conduits along the entire length of the track carry the output of the AC to AC converter, that is, the secondary power, and the track lighting system is limited to the use of light bulbs and/or electric fixtures driven by the same secondary electric power, that is, the output of the AC to AC converter. In addition, the AC to AC converter, interposed between the track and the power source, is usually in a fixed position, in a box or casing at or near the track supporting the conduits and make the lighting system unsightly. In order to avoid the unsightly appearance of the box the box is often imbedded in a wall or floor. Embedding or hiding the box supporting the AC to AC electric converter is costly and inconvenient when one desires to change the type of light bulb used in the track lighting system, since the AC to AC electric converter may need to be changed also.

SUMMARY OF THE INVENTION

The present invention is a novel track lighting system that provides a U shaped track which supports two or more electric conduits in grooves, in the cavity of the track where the grooves and the conduits therein extend, essentially, along the length of the track. The electric conduits in the track are connected to the standard electric power, or primary power, such as 110–120 volt, 60 cycle electric power, for example, so that the electric conduits, along the entire length of the track become the output for the primary electric power. An electric converter means, such as an AC to AC converter, for example, is supported in the track and is electrically connected to the conduits in the grooves of the track. The electric converter means is interposed between the conduits in the track and the light fixture in the track lighting system. The electric converter means is recessed in the track and supported by the track by inserting at least a portion of the electric converter means into the cavity of the track and securing the electric converter means in the track. The electric converter means may be held, recessed in the track at substantially any location along the track. The electric converter means is removable from the track and may therefore be repositioned from location to location, along the track, as desired. The electric converter means is electrically connected to the conduits in the grooves of the track by positioning input contacts of the electric converter means in the grooves of the track, so that the input contacts make electrical contact with the conduits in the track. The electric converter means is driven by the primary electric power and a secondary electric power, the output of the electric converter means, is provided. The characteristics or properties of the secondary electric power are defined by the requirements of the lamp bulb driven by the secondary power. Connecting the electric converter means to the conduits of the track may be done at substantially any location along the track. The electric converter means is movable so that it may be positioned at any location along the track. Since the electric converter means may be positioned at any location along the track and may be connected to the electric conduits at any point along the track, the secondary output of the electric converter means may be made available at any point along the track. The electric converter output may be a pair of terminals or wires for connection to an electric fixture, such as a chandelier, or an electric receptacle for receiving an electric plug, or a socket for receiving an electric light bulb, for example. Within the concept of the invention, a plurality of individual electric converter means are connected to the same track so that a plurality of secondary electric power sources, each having different electric characteristics from the characteristics of the primary power and from each other, are available along the length of the same track.

Typically, a track for a track lighting system is available in lengths of two, four and eight feet. The tracks may be fixed to a wall, floor or ceiling of a space or room, for example or may be hung, suspended or otherwise supported from the ceiling or some upper support in a structure, building or home, for example. The track is a U shaped channel with opposing lips located at the opening of the track.

From another aspect the invention provides an electricity converter means or electric converter means with an input, an output and a support/connector means which is supported in and connected to a track of a track lighting system. The electric converter means may be an AC to AC converter, an AC to DC converter or any other electric converter means which, when connected to a standard power, at its input, provides a secondary output having electric properties which differ from the electric properties of the standard power. Preferably, an electric converter means provides a secondary output having electric properties required to drive an high intensity discharge lamp bulb. The secondary power output may have electric characteristics for driving another type of lamp bulb such as an high intensity lamp bulb or other incandescent lamp bulb, or a fluorescent lamp bulb, for example. The electric properties of the output of the electric converter means is defined by the electric requirements needed to drive the lamp bulb used in conjunction with the particular electric converter means. The electric converter means may be fixed, providing an electric output with fixed characteristics or may be variable, having the capability of changing the electrical characteristics of its output, on demand. Accordingly, a central processing unit (CPU) or microprocessor may be used in association with the electrical converter means for controlling the output of the electric converter means. The memory of the CPU may be programmed to select one or more of a variety of electric characteristics available as an output of the variable output electric converter means. A key board, connected to the CPU is provided for selecting a program in the CPU, as desired. The CPU or microprocessor and key board may be used as a switching means to turn the electric converter means on and off, as desired.

Reference to a modular unit includes the electric converter means, its input element and output element and the support/connector means for holding the modular unit in the track and for connecting the electric converter means to the conduits in the track. Preferably, the electric converter means is mounted or retained within the case of the modular unit. A support/connector means, coupled to the casing of the modular unit and to the input of the electric converter means, is provided for holding and supporting the modular unit recessed in the cavity of the track and for connecting the electric converter means to the conduits in the track. The input of the electric converter is connected to conduits in the track carrying the primary electric power. The output of the electric converter means includes a socket adapted to secure an high intensity discharge lamp bulb.

By supporting and/or retaining a plurality of modular units along the same track, each modular unit including a different, distinct electric converter means so that each electric converter means provides a distinctive secondary electric power output having its own distinctive electric characteristics, several electric outputs, each having different electric characteristics is provided along the same track. Switching the modular units on and off may provide different lighting effects from a variety of lights controlled by the respective outputs.

DETAILED DESCRIPTION OF THE INVENTION

Figure 1:
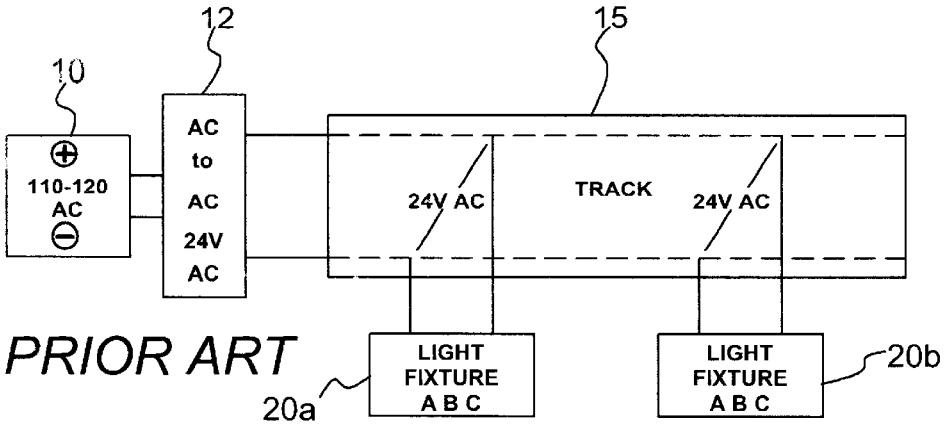
PRIOR ART Fig. 1
FIG. 1 is a block diagram representing the prior art.

FIG. 1, a block diagram, represents a prior art track lighting system. The sequence or location of units in the system is a power supply unit, block 10, which is a source for normally conventional electric power, here represented as 110–120 volt, 60 cycle alternating current (AC), referred to as primary or normal power. The next unit in the sequence of units in the prior art track lighting system is an AC to AC converter unit, block 12, which receives primary electric power of 110–120 volt, 60cycle AC, for example, and converts the primary electric power into a secondary electric power having characteristics that differ from the primary electric power. AC to AC converters are well known in the art. The secondary electric power is represented as 24 volt AC power, for example, and is applied to the electric conduits supported in grooves of the track, block 15. Thus, all the electric power that may be taken from the track has the same characteristics, that is, 24 volts AC, for example, the output of the AC to AC converter, block 12. The electric fixtures in the prior art track lighting system, are all driven by electric power having the same characteristics, that is, the output of the AC to AC converter, block 12. The electric fixtures or light fixtures connected to the track, represented by block 20*a* and 20*b*, are each driven by the same secondary power. The fixtures are identified by ABC to show a common relationship. If additional electric fixtures or light fixtures are connected into the same track system, by connections to the conduits of the track, each additional electric unit will be driven by the same secondary electric power, 24 volt AC power. This is the prior art.

Figure 2:
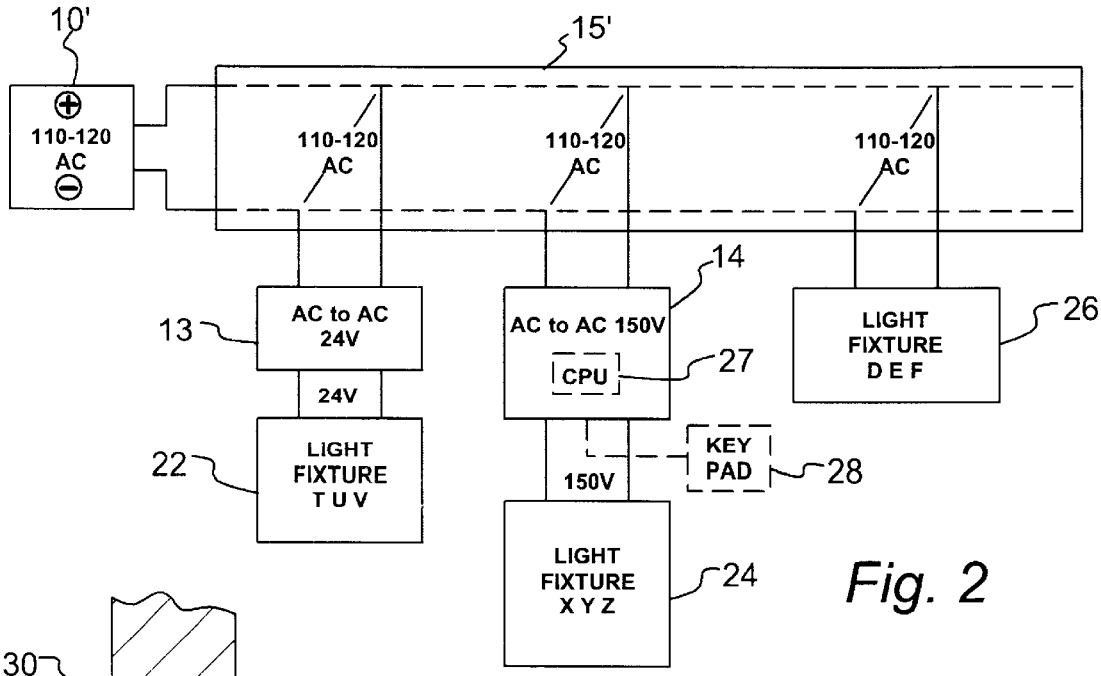
FIG. 2 is a block diagram representing the present invention.

FIG. 2 is a block diagram representing the present invention. The sequence or location of units in the novel track lighting system is changed substantially, providing a novel track lighting and fixture system with substantially greater diversity with respect to the use of electric and/or lighting fixtures in the system. The source of primary power in the present invention is represented in FIG. 2 as block 10'. This may be substantially the same type of power as represented in block 10 or, may be another power source corresponding to the power source represented by block 10. The out put of block 10 represents a conventional power source, such as 60 cycle, 110–120 volt AC power, for example. The conventional or standard or primary power is applied to electric conduits, supported in grooves, of the track represented by block 15'. Thus the track represented by block 15' carries standard power along its entire length, as represented by the broken lines in block 15'. The track represented by block 15' in FIG. 2, may be similar to the track represented by block 15 in FIG. 1. The AC to AC converter means, block 13, is connected to the conduits of the track. In accordance with a preferred embodiment of the invention, the AC to AC converter means, block 13, is connected to the track, block 15', both electrically and physically. The AC to AC converter means, block 13, is driven by the primary electric power and provides a secondary electric power output of, for example, 24 volts, AC power. The secondary power output of the AC to AC converter means 13 is applied to drive a light fixture or electric fixture, block 22, the fixture, identified by TUV, is designed to be driven by an electric power having characteristics found in the 24 volt, AC power output. A second AC to AC converter means, represented by block 14, is connected to the conduits in track represented by block 15'. This second AC to AC converter means, block 14, is driven by the 110–120 volt, AC primary power and provides a second secondary power output, which may be, 150 volt, AC power, for example. The second secondary power is used to drive a light fixture, block 24, identified by XYZ, which is designed to be driven by an electric power having the characteristics found in the 150 volt, AC power output. In addition, a light fixture or other electric fixture, represented by block 26, may be connected directly to the conduits of the track, block 15', without an intervening AC to AC converter means. Thus, the primary power is used directly, to drive light or electric fixtures, identified by DEF, for example.

The AC to AC converter means may be a fixed AC to AC converter means or may be a variable AC to AC converter means. The modular unit supporting the converter means may include a central processing unit (CPU) or a microprocessor, represented by broken line block 27, programmed to control the AC to AC converter means so that the out put of the converter means is changed, within the limits of the program, as desired. A CPU or microprocessor may be located in the modular unit and may be programmed to control a circuit, for example, which converts a primary current having first characteristics to a secondary current having second characteristics. A key pad, such as represented by broken line block 28, may be supported on the casing or shell of the modular unit, the key pad for selecting programs stored in the CPU or microprocessor.

Figure 3:
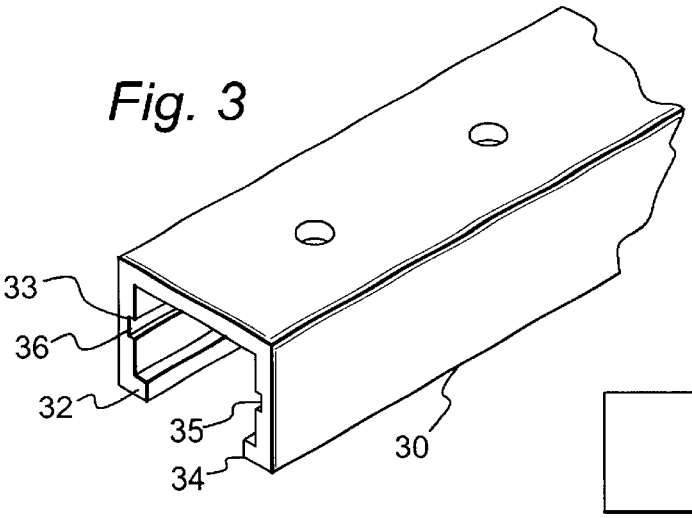
FIG. 3 is a representation of a track which may be used in the invention.

FIG. 3 represents a section of a track used in track lighting, the like of which may be used in the present invention. The track 30 is a U shaped, elongated track having inside extending lips 32 and 34, along the opening of the track. On each opposite inside wall of the track is a groove 33 and 35. Each groove supports an electric conduit 36 and 37, each conduit extends along the length of the track. The track may be fabricated from a conductor material, such as conductive metal or conductive plastic, for example, and each conduit would be insulated from the track. The track may be fabricated from a nonconductive material, such as nonconductive plastic, for example, and insulation from the track may not be required. The electric conduits 36 and 37 each have an open face so that electric connection may be made with each conduit, respectively, by inserting a contact, such as the tip contacts 42 and 44 on the extremes of the top 47 of the connector/support 41 on the modular unit, into the grooves 33 and 35, shown in FIG. 5.

Figure 5A:
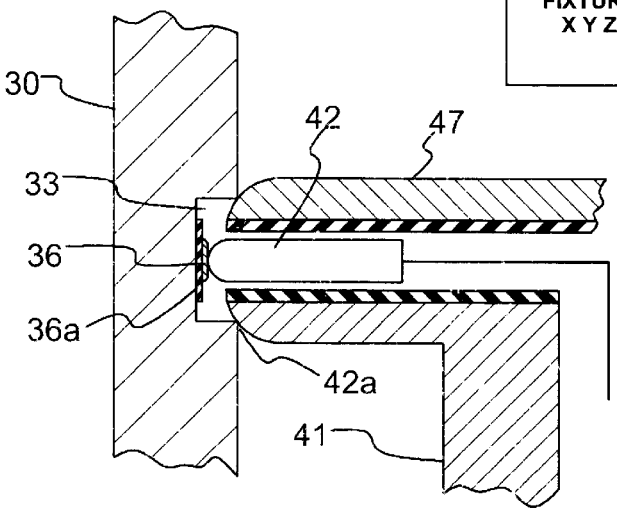
FIG. 5*a* is a cross section view of a portion of FIG. 5.
Figure 4A:
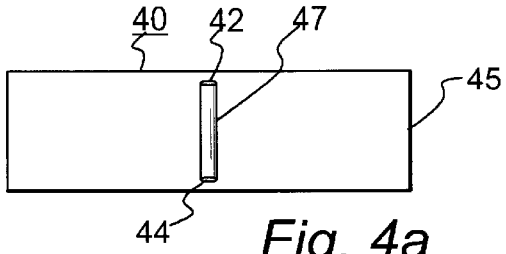
FIG. 4*a* is a representation, shown in top plan view, of a modular unit supporting an AC to AC converter means used in the invention.
Figure 4C:
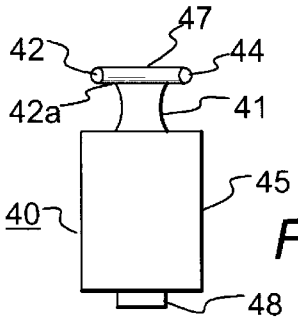
FIG. 4*c* is a representation of the modular unit of FIG. 4*a* in end elevation view.
Figure 4B:
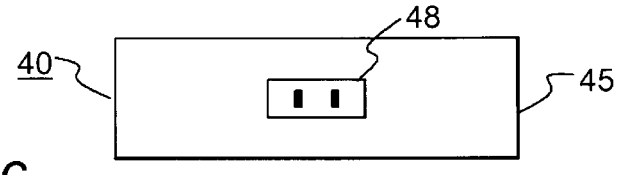
FIG. 4*b* is a representation of the modular unit of FIG. 4*a* in bottom plan view.
Figure 5:
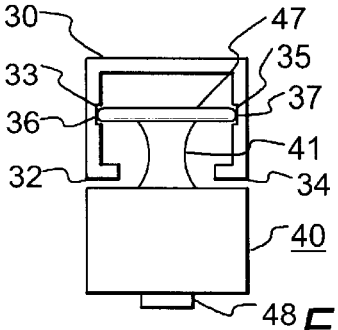
FIG. 5 is a view in cross section, representing a modular unit of FIG. 4*a* in the track of FIG. 3.
Figure 6:
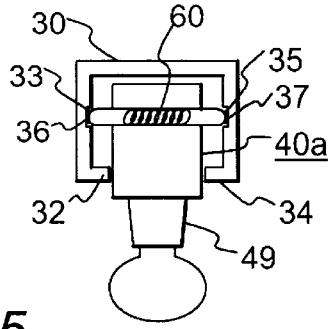
FIG. 6 is a view in cross section, representing an alternate form of the modular unit represented in FIG. 4*a*, in the track represented in FIG. 3.
Figure 7A:
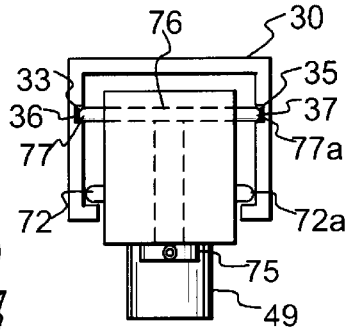
FIG. 7*a* is a cross section view of the invention shown in FIG. 7, along the lines 7*a*–7*a* of FIG. 7.
Figure 7:
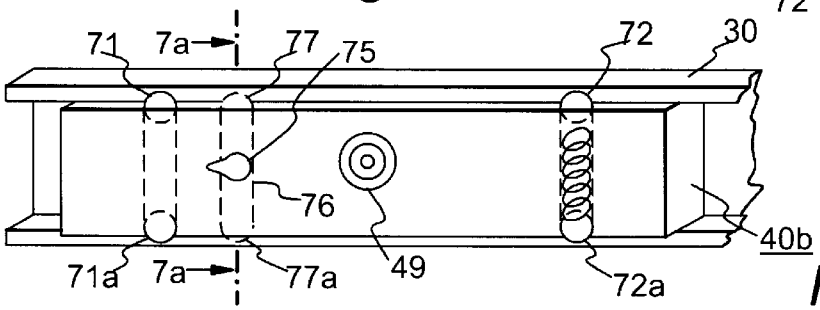
FIG. 7 is a representation of another alternate form of modular unit represented in FIG. 4*a* in the track represented in FIG. 3.

FIG. 4*a* represents a modular unit which includes an AC to AC converter means. Preferably, the modular unit is in the form of an elongated hollow shell which supports the electric components and/or circuitry of the AC to AC converter means, for converting a primary electric power, such as a conventional 110–120 volt, 60 cycle AC, to a secondary electric power, the secondary electric power having electric characteristics that differ from the electric characteristics of the primary electric power. A secondary electric power may be, for example, a 24 volt, 60 cycle AC power, or a 12 volt, 60 cycle AC power or a 110–120 volt, 60 cycle AC, which is pulsed with a voltage spike exceeding 120 volts, for example. The electric power converter means may be an AC to AC converter means, an AC to DC converter means, a DC to DC converter means or a DC to AC converter means. Preferably the electric power converter means is a state of the art AC to AC converter. The hollow shell or casing supporting the AC to AC converter means is elongated and has a width which is substantially the same width as the track, as represented in FIG. 5 or the hollow shell or casing may be elongated and has a width that is sufficiently narrow to fit inside the track, as represented in FIGS. 6, 7 and 7*a*. Although the preferred modular unit is represented in rectangular form or shape, the geometric form of the modular unit may differ, if desired, and modular units containing an AC to AC converter means may be in other geometric forms or shapes when practicing the invention.

Referring to FIGS. 4*a*, 4*b*, 4*c* and 5, the modular unit 40 containing or supporting the AC to AC converter means includes a hollow body or casing 45 and a top connector-support 41. At the extremes of the head 47 of the connector-support are contacts 42 and 44. The connector-support is inserted into the track by rotating the modular unit so that the long portion of the connector-support is parallel with the opening of the track. The connector-support is inserted into the track sufficiently far so that the head of the connector-support is at the same position or location as the grooves on the inside of the track. The modular unit 40 is rotated 90 degrees so that the extremes of the head of the connector-support slide into the grooves 33 and 35 and the tip contacts 42 and 44 make electrical contact with the conduits 36 and 37 in the grooves 33 and 35. The tip contacts 42 and 44, which are insulated from the head and make contact with the AC to AC circuit, are sufficiently narrow to pass through the grooves 33 and 35 and make isolated contact with the conduits in the grooves, respectively. The head portion behind the tip contacts is sufficiently large to partially enter the grooves, respectively, and become secured in the grooves. The ends inside the tip contacts on the head 47 in the grooves 33 and 35 support the modular unit 40, in the track. The bottom side of the modular unit represented in FIG. 4*b*, includes an output connection for the AC to AC converter means represented as an electric receptacle 48. The modular unit 40*a* in FIG. 6 and 40*b* in FIGS. 7 and 7*a* each include an output connection for the AC to AC converter represented as a socket 49. The socket 49 may be adapted to hold an high intensity discharge lamp bulb or an incandescent lamp bulb or a fluorescent lamp bulb, for example. FIG. 5*a* is an enlarged sectional diagram representing a portion of the wall of the track 30 and the groove 33 in which is supported the conduit 36 on an insulator 36*a*. The tip contact 42 is represented fixed in an insulated shield in the head 47, although the tip contacts in the end of the head may be spring-loaded. The end 42*a* abuts the edges of the groove 33 and, with the cooperation on the end at the other extreme of the head, holds the modular unit in the track. The other half of the head of the connector/support is essentially a mirror image of the representation in FIG. 5*a*.

FIGS. 6, 7 and 7*a* represent alternate arrangements for holding or supporting a modular unit in a track, for connecting the electricity converter means in the modular unit to the conduits in the grooves of the track. FIG. 6 represents an arrangement of the invention in which a modular unit 40*a* includes a spring-loaded connector-support 60, extending from the exterior of the wall. The modular unit 40*a* is sufficiently narrow to fit between the lips 32 and 34 of the track 30. The extremes of the spring-loaded connector-support 60 are wider than the interior of the walls of the track. With the extremes of the spring-loaded or biased connector-support 60 receded, by pressing the retractable extremes into the wall of the body of the modular unit, the modular unit is slid into the opening of the track, between the lips 32 and 34. The modular unit is slid into the track until the extremes of the spring-loaded connector-support slip into the grooves 33 and 35 in the inside wall of the track 30. The tips of the spring-loaded connector-support are contacts for the AC to AC converter means. The contacts make electrical connection with the conduits 36 and 37 in the grooves 33 and 35 of the track 30. Thus, the modular unit is supported in the track by the spring-loaded connector-support 60 and the AC to AC converter means, in the modular unit 40*a*, is connected to the primary current source by the spring-loaded connector-support 60. The out put connection of the AC to AC converter means is represented as a socket 49 for an electric light bulb, not shown.

FIGS. 7 and 7*a* represent another alternate arrangement of the invention in which a pair of spring loaded supports 71/71 a and 72/72*a*, in the walls of the modular unit 40*b*, recede into the walls of the modular unit to permit the modular unit to pass through the opening of the track, at the lips 32 and 24. The spring-loaded supports 71/71*a* and 72/72*a* extend past the lips 32 and 34 toward the walls of the track 30 and hold the modular unit 40*b* in the track. An external rotatable head 75 connects with the internal head 76 on which are the fixed tip contacts 77 and 77*a*. The internal head 76, when rotated, recedes into the walls of the modular unit 40*b*. This permits the modular unit to be inserted into the track cavity. With the modular unit in the cavity of the track, the rotatable head is rotated back and the contacts 77 and 77*a* on the head 76 extend into the grooves 33 and 35 and make contact with the conduits 36 and 37. The modular unit supporting the electric converter means is thus suspended in the cavity of the track and the electric converter means is connected to the standard power carried in the conduits in the grooves of the track.

In the forgoing description of the invention, referenced to the drawings, certain terms have been used for conciseness, clarity and comprehension. However, no unnecessary limitations are to be implied from of because of the terms used, beyond the requirements of the prior art, because such terms are used for descriptive purposes and are intended to be broadly construed. Furthermore, the description, including the block diagram and the illustrated representations of the invention, although represented in a preferred arrangement and in alternate arrangements are by way of example, and the scope of the invention is not limited to the exact details represented or described.

A preferred embodiment of this invention has been represented and described along with alternative arrangements and suggested changes. Other changes may be made, as may become apparent to those skilled in the art, without departing from the invention defined in the claims.

What is claimed is:

1. A track lighting system including:

a) an elongated track having a U shaped configuration, having an elongated base and opposing walls extending from said base, said base and said opposing walls defining a cavity in said track, first and second grooves means extending along said elongated track and first and second conduits means extending along said elongated track, said first groove means supporting said first conduit means and said second groove means supporting said second conduit means, each wall of said opposing walls terminating in a lip means, each said lip means extending toward each other defining an opening to said cavity;

b) an electric power supply having at least first and second terminals, said first terminal connected to said first conduit means and said second terminal connected to said second conduit means, said electric power supply providing electricity having first electric properties;

c) an electricity converter means having an input means and an output means, said electricity converter means for changing said first electric properties of said electric power supply into second electric properties of a second power said second electric power applied to said output means;

d) said input means of said electricity converter means having first and second terminals means, said first terminal means connected to said first conduit means and said second terminal means connected to said second conduit means; and, e) said electricity converter means including a support means, said support means for passing through said opening for securing said electricity converter means in said cavity.

2. A track lighting system as in claim 1 and further including:

a receptacle means, for receiving an electric plug, connected to said output means.

3. A track lighting system as in claim 1 and further including:

a socket means connected to said output, said socket means adapted to secure a lamp bulb means.

4. A track lighting system as in claim 3 and further including:

a) a switch means coupled to said electricity converter means for selectively driving said electricity converter means from a first condition to a second condition for changing a condition of said lamp bulb means.

5. A track lighting system as in claim 3 wherein said lamp bulb means is a high intensity discharge lamp bulb adapted to be driven by an electric power having said second electricity properties.

6. A track lighting system as in claim 1 and in which said electricity converter means is adapted to pass through said opening and said support means includes:

a recessable biased tip means which, when in recessed position is capable of passing through said opening and when in extended position extends beyond said opening at said lip means for holding said electricity converter means in said cavity.

7. A track lighting system as in claim 6 and in which said switch means is a microprocessor programmed to change said electricity converter means from a first condition to a second condition.

8. A method for constructing a track lighting system for home and/or business use including the steps of:

a) applying a standard electric power supply to first and second electric conduits in first and second grooves on first and second walls extending from a base, said first and second walls and said base defining a cavity of an elongated track in U configuration, said standard electric power supply having first electric characteristics;

b) connecting an input means of an electric converter means adapted to fit into said cavity, to said first and second electric conduits in said first and second grooves, for driving said electric converter means for changing said first characteristics of said standard electric power supply to second characteristics of a second power supply, said electric converter means including means insertable into said cavity for coupling with a portion of said cavity for supporting said electric converter means in said cavity; and c) driving an electric fixture means with said second power supply.

9. A method as in claim 8 and further including the steps of:

a) connecting a second input means of a second electric converter means adapted to fit into said cavity, to said first and second electric conduits in said first and second grooves, for driving said second electric converter means for changing said first characteristics of said standard electric power supply to third characteristics of a third power supply, said second electric converter means including second means insertable into said cavity for coupling with a second portion of said cavity for supporting said second electric converter means in said cavity; and b) driving a second electric fixture with said third electric power.

10. An improvement in a track lighting system where a standard electric power having first electric properties is directly applied to first and second spaced electric conduit means carried in first and second opposite walls extending from a base of an elongated track where said opposite walls and said base define a cavity in said track, said improvement comprising:

a) an AC to AC converter means having an input means and an output means, said input means connected to said first and second spaced electric conduit means for applying said standard electric power to said AC to AC converter means, said AC to AC converter means adapted to be driven by said standard electric power for changing said standard electric power having said first electric properties to a second electric power having second electric properties, said second electric power applied to said output means of said AC to AC converter means;

b) support means coupled to said AC to AC converter means extending into said cavity and connecting with said cavity for supporting said AC to AC converter means in juxtaposition to said track at an opening of said cavity; and c) a lamp bulb means adapted to be driven by an electric power having said second electric properties, said lamp bulb means connected to said output means of said AC to AC converter means.

11. An improvement in a track lighting system as in claim 10 where said output means of said AC to AC converter means is adapted to secure and connect to said lamp bulb means and said lamp bulb means is an high intensity discharge lamp bulb.

12. An improvement in a track lighting system as in claim 10 and including a) a second AC to AC converter means having a second input means and a second output means, said second input means connected to said first and second spaced electric conduit means for applying said standard power to said second AC to AC converter means, said second AC to AC converter means adapted to be driven by said standard electric power for changing said standard electric power having said first electric properties to a third electric power having third electric properties, said third electric power applied to said second output means of said second AC to AC converter means;

b) second support means coupled to said second AC to AC converter means extending into said cavity and connecting with said cavity for supporting said second AC to AC converter means in juxtaposition to said track at said opening of said cavity; and c) a second lamp bulb means adapted to be driven by an electric power having said third electric properties, said second lamp bulb means connected to said second output means of said second AC to AC converter means.

* * * * *